US010182286B2

(12) United States Patent
Wu et al.

(10) Patent No.: US 10,182,286 B2
(45) Date of Patent: Jan. 15, 2019

(54) SOUND DEVICE

(71) Applicant: AAC Technologies Pte, Ltd., Singapore (SG)

(72) Inventors: Shuwen Wu, Shenzhen (CN); Wei Song, Shenzhen (CN); Haifei Huang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/649,314

(22) Filed: Jul. 13, 2017

(65) Prior Publication Data

US 2018/0255392 A1 Sep. 6, 2018

(30) Foreign Application Priority Data

Mar. 1, 2017 (CN) ..... 2017 2 0196807 U

(51) Int. Cl.

| | |
|---|---|
| ***H04R 1/02*** | (2006.01) |
| ***H04R 1/28*** | (2006.01) |
| ***H04R 7/18*** | (2006.01) |
| ***H04R 9/06*** | (2006.01) |
| ***H04R 9/02*** | (2006.01) |

(52) U.S. Cl.

CPC ..... *H04R 1/2811* (2013.01); *H04R 7/18* (2013.01); *H04R 9/025* (2013.01); *H04R 9/06* (2013.01); *H04R 2400/11* (2013.01)

(58) Field of Classification Search

CPC combination set(s) only.
See application file for complete search history.

(56) References Cited

U.S. PATENT DOCUMENTS

2012/0148084 A1* 6/2012 Fathollahi ..... H04R 1/24 381/386
2015/0078609 A1* 3/2015 Tseng ..... H04R 1/1016 381/386

* cited by examiner

*Primary Examiner* — Amir H Etesam
(74) *Attorney, Agent, or Firm* — Na Xu; IPro, PLLC

(57) ABSTRACT

The invention discloses a sound device. The sound device includes a frame and a lower plate. The frame includes a side wall and a leaking hole penetrating the side wall. The sound device also includes an air-permeable isolator covering the leaking hole, and the air-permeable isolator covers the leaking hole completely. Compared with the related technologies, when the sound device is provided in the box body to form a sound device box, a back cavity circumvented and formed by the sound device and the sound device box can be directly filled with acoustic absorbent to form a virtual acoustic cavity.

11 Claims, 2 Drawing Sheets

SOUND DEVICE

FIELD OF THE PRESENT DISCLOSURE

The present disclosure relates to the field of electroacoustic transducers, more particularly to a sound device for converting electric signals to audible sounds.

DESCRIPTION OF RELATED ART

With the upcoming of mobile internet era, the number of smart mobile equipment keeps increasing. Among numerous mobile equipment, mobile phone is undoubtedly the most common and portable mobile terminal device. Currently, the mobile phone has a large variety of functions includes but not limited to high-quality music function; thereby sound devices used for sound playing are widely applied in current smart mobile equipment.

The sound device of related technologies includes a frame, an upper cover and a lower plate installed respectively as cover on both sides of the frame and a vibration system and a magnetic circuit system fixed on the frame.

However, as to the sound device of related technologies, a leaking hole is arranged penetrating the lower plate, an auxiliary leaking hole is arranged on the side wall of the frame. The magnetic bowl of the magnetic circuit system cannot be designed as an exposed structure due to the fact that the leaking hole is arranged on the lower plate, when the sound device is installed in a box body and forms a sound device box, and due to the same reason that the leaking hole is arranged on the lower plate, the back cavity circumvented and formed by the sound device and the sound device box cannot be directly filled with acoustic absorbent to form a virtual acoustic cavity, either.

Therefore it is necessary to provide an improved sound device for overcoming the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
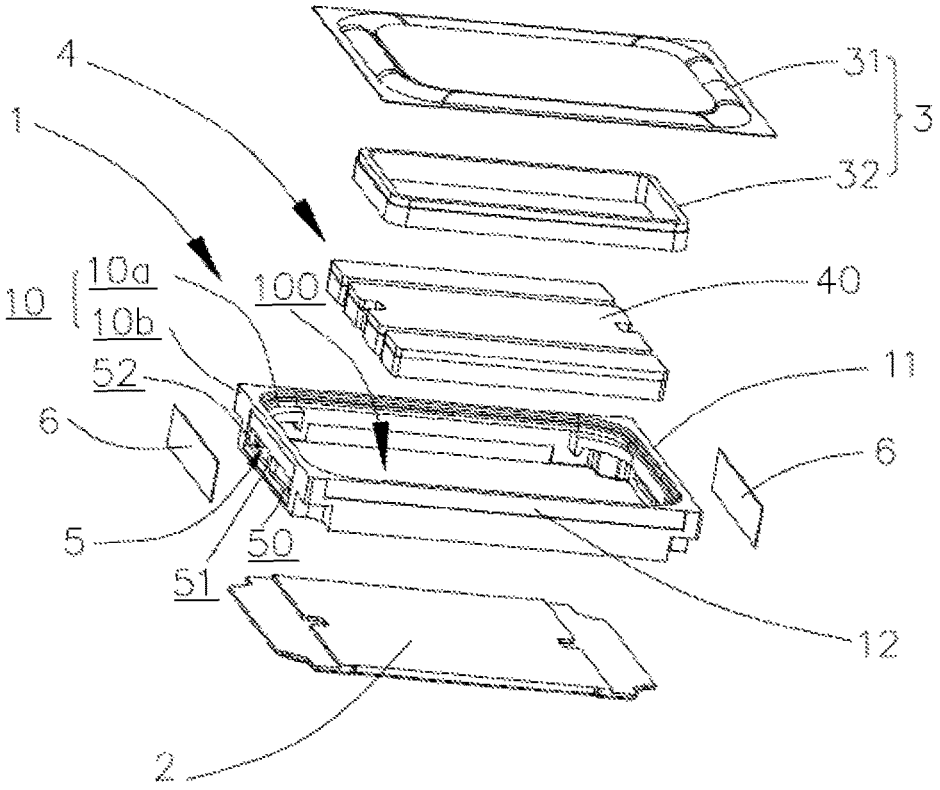
FIG. 1 is an isometric and exploded view of a sound device in accordance with an exemplary embodiment of the present disclosure.
Figure 2:
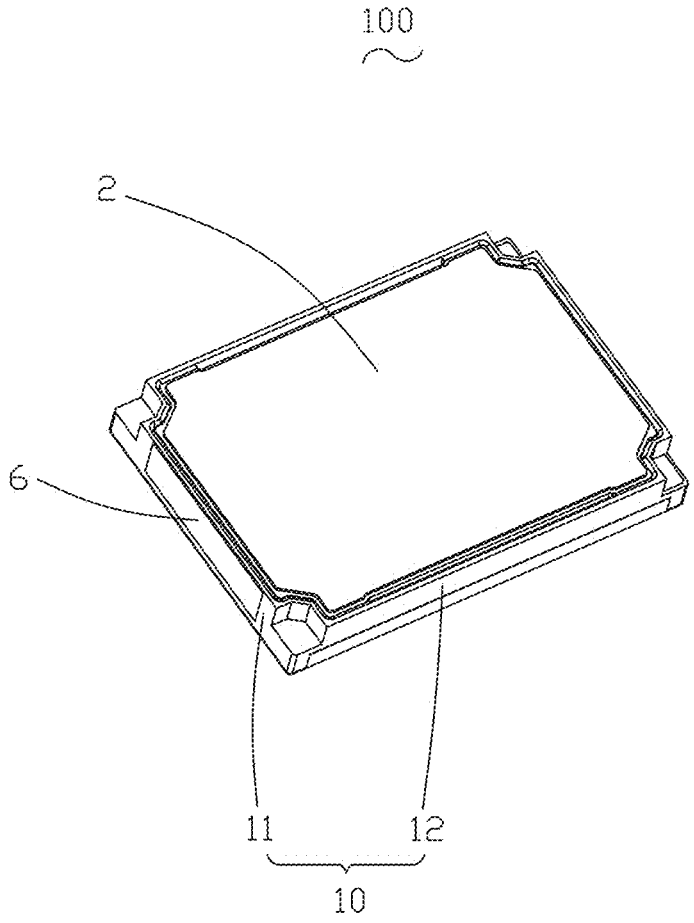
FIG. 2 is an isometric and assembled view of the sound device in FIG. 1.

Referring to FIGS. 1-2, a sound device 100 in accordance with an exemplary embodiment of the present disclosure, comprises a frame 1 and a lower plate 2 arranged as a cover of the frame 1, a vibration system 3 and a magnetic circuit system 4 fixed on the frame 1, a leaking hole 5 for leakage arranged penetrating the frame 1, and an air-permeable isolator 6 covering the leaking hole 5.

The frame 1 is formed by a side wall 10, the lower plate 2 is installed on a bottom of the side wall 10 to form an accommodation space 100, and the leaking hole 5 is installed penetrating the side wall 10. The side wall 10 includes an inner surface 10*a* and an outer surface 10*b* opposite to the inner surface, the leaking hole 5 penetrating the inner surface 10*a* and the outer surface 10*b*, wherein, a surrounding surface 50 is formed on the side wall, the leaking hole 5 is bounded by the surrounding surface 50, and a recess 52 corresponding to the leaking hole 5 is concave from the outer surface 50*b* to receive the air-permeable isolator 6, the surrounding surface 50 connecting the inner surface 50*a* with the outer surface 50*b*, the leaking hole 5 communicating with the recess 52. The frame 10 further comprises a supporting part 51 connecting with the surrounding surface 50 and crossing the leaking hole 5, and the air-permeable isolator 6 covers the supporting part 51.

Concretely, the side wall 10 includes two opposite first side walls 11 and two opposite second side walls 12. The first side walls 11 and the second side walls 12 form the frame 1 together, and the leaking hole 5 is arranged penetrating the first side walls 11.

In this embodiment, the length of the first side walls 11 is smaller than that of the second side walls 12, the first side walls 11 and the second side walls 12 can enclose the frame 1 and shape it into a rectangle.

The lower plate 2 and the frame 1 can be sealed by placing sealing glue between them.

The vibration system 3 includes a diaphragm 31 fixed on the frame and a voice coil 32 driving the diaphragm 31.

The magnetic circuit system 4 generates a magnetic field and work together with the vibration system 3 to drive. Through the magnetic circuit system 4, the vibration system 3 can be activated to vibrate and to make sound.

It needs to be explained that the lower plate 2 can be a part of the magnetic circuit system 4, the lower plate 2 is a base plate of the magnetic circuit system 4 on which the magnet steel 40 is placed, it can be a tabular magnetizing plate or a bowl-form bottom wall of a magnetic bowl.

The air-permeable isolator 6 covers the leaking hole 5 and covers the leaking hole 5 completely. Concretely, the air-permeable isolator 6 is a net cloth or a metal net, of course, it can also be of other material.

In this embodiment, there are two leaking holes 5 arranged respectively on the two first side walls 11, and there are two air-permeable isolators 6 arranged respectively on the two leaking holes 5. Preferably, the two leaking holes 5 are installed right facing each other.

In this embodiment, the air-permeable isolator 6 and the frame 1 are formed all-in-one with injection molding, this structure enhances the fixing fastness of the air-permeable isolator 6 and improves the stability of the sound device 100.

For the sound device of this utility model, the leaking hole is arranged on the side wall of the frame, and the air-permeable isolators is additionally installed as a cover on the leaking hole, at the same time, the frame and the lower plate installed as a cover on the frame are sealed with sealing glue, making it possible that the sound device completed leakage on the side wall. When the sound device is installed in a box body, the back cavity circumvented and formed by the sound device and the sound device box can be directly filled with acoustic absorbent to form a virtual acoustic cavity, improving the acoustic performance of the sound device; additionally, the frame of the sound device can also be replaced by the lower plate of the magnetic circuit system through exposure design, making the structure simpler.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound device, comprising:

a frame including a side wall and a leaking hole penetrating the side wall;

a lower plate engaging with the frame to form an accommodation space;

an air-permeable isolator completely covering the leaking hole; and a vibration system and a magnetic circuit system fixed on the frame, with the magnetic circuit system received in the accommodation space, the magnetic circuit comprising a magnetic steel placed on the lower plate;

the side wall comprising an inner surface and an outer surface opposite to the inner surface, the leaking hole penetrating the inner surface and the outer surface, wherein, a surrounding surface is formed on the side wall, the leaking hole is bounded by the surrounding surface, and a recess corresponding to the leaking hole is concave from the outer surface to receive the air-permeable isolator, the surrounding surface connecting the inner surface with the outer surface, the leaking hole communicating the recess with the accommodation space.

2. The sound device as described in claim 1, wherein the air-permeable isolator is integrated with the frame by injection molding.

3. The sound device as described in claim 1, wherein the side wall includes two opposite first side walls and two opposite second side walls, the first side walls and the second side walls form the frame together, and the leaking hole is formed in the first side wall.

4. The sound device as described in claim 3, wherein a length of the first side wall is smaller than that of the second side wall.

5. The sound device as described in claim 4 comprising two leaking holes arranged respectively on the first side walls, and two air-permeable isolators covering respectively on the two leaking holes.

6. The sound device as described in claim 5, wherein the two leaking holes are aligned with each other.

7. The sound device as described in claim 1, wherein the air-permeable isolator is a net cloth or a metal net.

8. The sound device as described in claim 1, wherein the lower plate is a base plate of a magnetic circuit system.

9. The sound device as described in claim 1, wherein the frame further comprises a supporting part connecting with the surrounding surface and crossing the leaking hole, and the air-permeable isolator covers the supporting part.

10. The sound device as described in claim 1, wherein the lower plate is a tabular magnetizing plate.

11. The sound device as described in claim 1, wherein the air-permeable isolator is integrally molded with the frame.

* * * * *